United States Patent [19]

Townsend

[11] Patent Number: 4,520,980

[45] Date of Patent: Jun. 4, 1985

[54] ELONGATE COMPRESSION BEARING MEMBER

[75] Inventor: Rodney C. Townsend, Johannesburg, South Africa

[73] Assignee: Mine Support Systems (Proprietary) Ltd., South Africa

[21] Appl. No.: 203,791

[22] Filed: Nov. 3, 1980

[30] Foreign Application Priority Data

Nov. 2, 1979 [ZA] South Africa ..... 79/5882

[51] Int. Cl.[3] ..... E04G 25/00

[52] U.S. Cl. ..... 248/351; 248/357; 405/288

[58] Field of Search ..... 248/351, 356, 357, 548, 248/542; 405/250, 251, 252, 255, 288; 52/DIG. 7, 301, 653, 649, 728

[56] References Cited

U.S. PATENT DOCUMENTS

| | | | |
|---|---|---|---|
| 1,471,124 | 10/1923 | Handl | 405/250 |
| 1,642,603 | 9/1927 | Conway | 248/351 |
| 1,759,786 | 5/1930 | Hardin | 405/250 |
| 1,996,401 | 4/1935 | Bowen | 52/301 |
| 2,701,449 | 2/1955 | Young | 405/250 |
| 3,372,552 | 3/1968 | Liddell | 52/728 X |
| 4,283,449 | 8/1981 | Damminger | 52/DIG. 7 X |

FOREIGN PATENT DOCUMENTS

| | | | |
|---|---|---|---|
| 575018 | 3/1933 | Fed. Rep. of Germany | 248/542 |
| 574822 | 4/1933 | Fed. Rep. of Germany | 248/542 |
| 810863 | 8/1951 | Fed. Rep. of Germany | 248/542 |
| 155716 | 8/1956 | Sweden | 248/351 |
| 118969 | 9/1918 | United Kingdom | 248/548 |
| 288011 | 4/1928 | United Kingdom | 248/351 |

*Primary Examiner*—J. Franklin Foss

*Attorney, Agent, or Firm*—Mason, Fenwick & Lawrence

[57] ABSTRACT

A prop intended particularly for use in underground mines, is made of timber. At one or both ends of the prop, a reduced diameter portion is formed. The rest of the prop has a larger diameter. At the end or ends of the larger diameter portion adjacent the reduced diameter portion(s), a restraining ring surrounds the prop.

5 Claims, 11 Drawing Figures

ELONGATE COMPRESSION BEARING MEMBER

FIELD OF THE INVENTION

This invention relates to an elongate compression bearing member, otherwise called a prop, which is designed to yield under predetermined high compressive loads. Such members are generally, but not necessarily exclusively, utilized as props in underground mines.

Whilst it is the intention that the scope of this invention is to be interpreted as extending to elongate compression bearing members other than props for use in mines, for the purposes of clarity and convenience the term "prop" will be utilized hereinafter to mean an elongate compression bearing member.

BACKGROUND TO THE INVENTION

Numerous different types of props have been proposed and manufactured heretofore and, most of the inexpensive or relatively inexpensive props have been made of wood.

Prop designers aim to produce a prop which will yield when it initially accepts a compression load and which has a steadily increasing resistance to such yield but which remains stable and continues to support a load after yielding.

An early proposal was to sharpen the end of a wooden pole so that a pointed end initially supported the load. As the load increased, the point was flattened so that the load acted on a continuously increasing area of the pole. Such poles had improved characteristics when compared with plain poles with unshaped ends, but still left a lot to be desired so far as load bearing capability was concerned.

Various other attempts have been made to manufacture effective and yet inexpensive timber props and these attempts vary widely in their approach and construction. One of the most important and effective props manufactured to date consists of a turned or otherwise rounded pole located tightly within a ductile metal pipe acting as a sleeve. In use this prop can contract under compressive loads and in fact, when the length thereof has been shortened to a certain extent, the pipe or sleeve can deform outwardly to accept the displaced bulk of the wood composition.

Another proposal has been to encase a pole within a sheath of glass fibre reinforced epoxy resin material with the same ultimate end in view.

SUMMARY OF THE INVENTION

According to the present invention, there is provided a timber prop comprising a pole defining at least the central core of the prop and wherein the prop has a major portion of its length having an enlarged cross-section relative to that of an end of the pole which protrudes from said major portion, and a restraining ring around the major portion adjacent the protruding end to restrain hoop stresses arising in the major portion when an axial compressive force is exerted on the protruding end.

Either one or both ends of the prop can have a protruding end of cross-section less than that of the major portion of the length of the prop. A restraining ring would be required adjacent each protruding end.

The prop is preferably formed from a single length of timber, the end or ends of which are reduced in diameter to form the protruding ends. The restraining ring or rings are then applied around that part of the timber which has not been reduced in diameter.

The restraining rings may be active or passive, i.e. they may be applied to the prop under tension, or they may simply be applied around the prop so as to be a close fit thereon.

In an alternative construction, the prop may comprise a central pole which is surrounded by separate staves forming the outer circumference of the major portion of enlarged diameter, so that one or both ends of the pole protrude beyond the staves. The staves would be retained in place around the pole by a plurality of retaining rings, some of which may form the restraining rings resisting hoop stresses.

To improve the resistance of the prop to buckling, metal bars may be applied along the length of the enlarged diameter portion of the prop. For example, these bars may be inserted in saw cuts extending parallel to the axis of the prop and through the "jacket" formed around the central core of the prop by the enlarged diameter of the major portion. Alternatively, these bars can be located between the staves if staves are used to form the enlarged diameter major portion.

The bars may be formed of metal plate or may form the stem of a T-shaped metal section which may for example be made by folding a metal sheet.

The profile of the protruding end may take one of a variety of forms. In a preferred form, the end is in the form of a frustum of a cone, with the larger diameter end of the frustum being of smaller diameter than the enlarged major portion of the prop. A number of other variants are shown in the drawings accompanying this application. In some variants, the protruding end is provided with a metal sleeve and this sleeve may extend into the enlarged diameter major portion of the prop.

It is also possible to combine one prop according to the invention with a timber prop which does not have protruding ends of reduced diameter, or with a second prop according to the invention. To combine two props in this way, a metal sleeve is used to surround a butt joint between the two props and to prevent bowing of the longer prop thus formed in the region of the joint. The metal sleeve then takes on the function of a restraining ring and resists hoop stresses arising in the enlarged diameter region of the prop or props according to the invention.

In a more general aspect of the invention, the part of the prop which has the smaller cross-section does not have to be at the end of the prop. However, if the part of smaller cross-section is in the middle of the prop, there is a danger of the prop bowing or buckling about this smaller cross-section part, and it is necessary to take steps to prevent such bowing or buckling.

Accordingly, the present invention also provides a timber prop which, over a minor part of its length intermediate its ends, has a cross-section less than that of the major part of its length wherein a restraining ring is provided around the major part of the prop wherever the minor part meets the major part of the prop, the restraining ring being arranged to resist hoop stresses arising in the major part of the prop when the prop is subjected to an axial compressive force, and wherein stiffening means are provided to prevent the prop bowing or buckling about the minor part.

BRIEF DESCRIPTION OF THE DRAWING

The invention will now be further described by way of example, with reference to the accompanying drawing, in which.

DETAILED DESCRIPTION OF PREFERRED EMBODIMENTS

Figure 1:
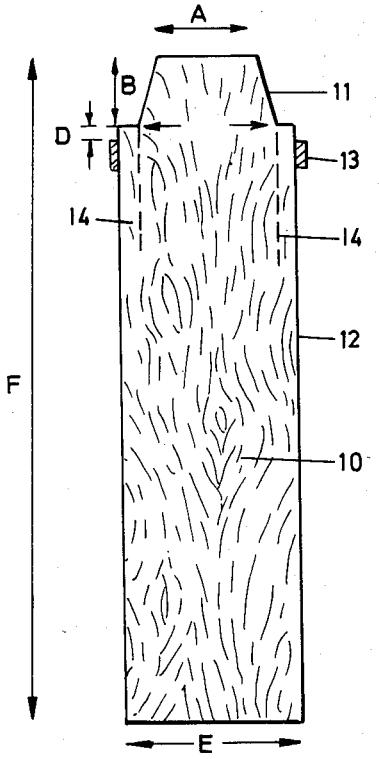
FIG. 1 is a cross-section through a preferred form of prop according to the invention.

The prop shown in FIG. 1 is formed from a single timber element 10. At one end 11, the element is profiled to the shape shown by any suitable method such as the use of suitable rotating cutting heads which cut away the surplus material. The profiling of the end 11 leaves an enlarged diameter major portion 12 of the prop. At the end of this major portion 12 adjacent the end 11, a restraining ring 13 is positioned around the prop. The prop thus formed is then ready for use to support compressive loads. In an underground mine, the prop will be positioned between the foot and hanging walls in a conventional manner.

When the prop comes under designed load, the reduced diameter end portion 11 first of all yields. Some of this end portion is effectively compressed into a central region of the prop indicated generally between dotted lines 14. The presence of the restraining ring 13 resists hoop stresses arising in the area of the major portion generally outside the dotted lines 14.

Once the end 11 has been compressed onto the enlarged diameter portion 12, the compressive load will come on the full cross-section of the portion 12. However as a result of the compression which has already taken place in the core of the prop, some of the fibre structure of the timber has broken down and this results in increased resistance to deformation of the prop under further load.

In this way, the prop shown has the desirable characteristics of an initial yielding stage where controlled yield occurs, followed by a stage of relatively high resistance to further deformation.

A prop substantially of the form as shown in FIG. 1 but with the following dimensions produced satisfactory results.

A—160 mm
B—150 mm
C—170 mm
D—50 mm
E—210 mm
F—1200 m

The ring 13 was made of mild steel of 4,5 mm thickness and 30 mm width. Materials other than metal and with a suitable tensile strength, for example glass-fibre reinforced epoxy resins, can be used for the ring 13.

Tests have also established that for this prop the maximum safe slenderness is when the ratio of diameter to overall length of the prop is not greater than about 1 to 12. Above this ratio, i.e. when the prop is more slender than determined by this ratio, the prop is liable to become unstable and may buckle before taking up its full load.

Figure 2:
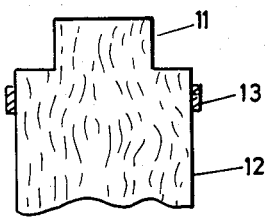
FIGS. 2 to 7 show different profiles for the upper end of the prop shown in FIG. 1.

FIG. 2 shows a profile where the protruding end has parallel sides.

Figure 3:
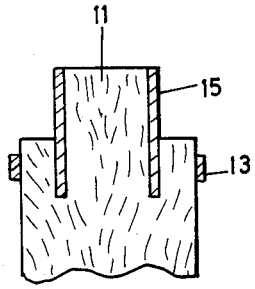

FIG. 3 shows the same profile as FIG. 2, but with the protruding end reinforced by a sleeve 15 of metal or other suitable material such as glass-fibre reinforced epoxy resin. In the embodiment shown, the sleeve 15 projects into the major portion 12 of the prop. In another embodiment which is not shown, the sleeve extends only as far as the shoulder between the end 11 and the major portion 12.

Figure 4:
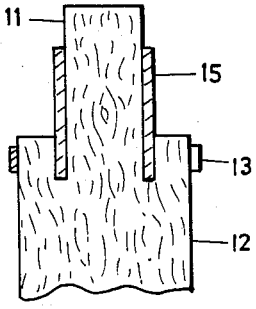

FIG. 4 shows a profile similar to that in FIG. 3 but with the end of the timber pole extending above the metal sleeve 15.

Figure 5:
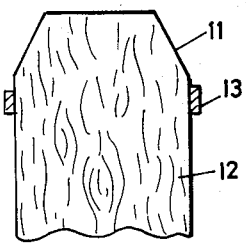

FIG. 5 shows a profile where the protruding end is in the form of a frustum of a cone with the large diameter end of the frustum equal in diameter to the major portion 12 of the prop.

Figure 6:
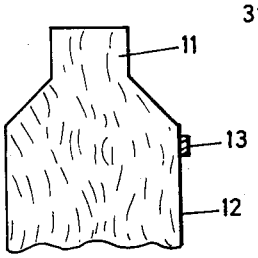
Figure 7:
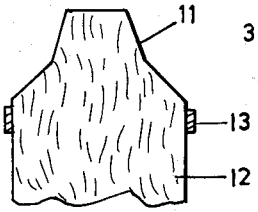

FIGS. 6 and 7 show further alternative profiles.

The various profiles shown have different yield characteristics, and the choice of which profile to use will depend upon the desired characteristics in the particular application.

Figure 8:
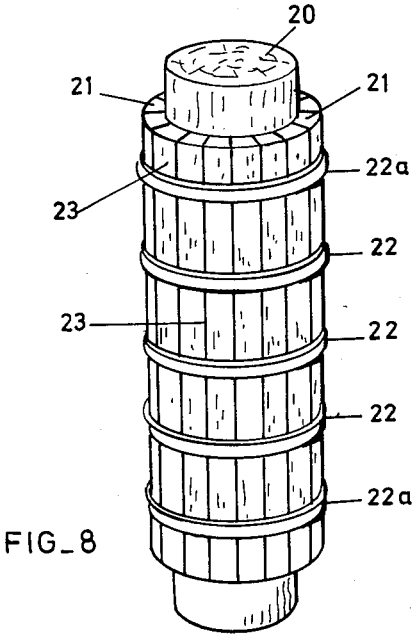
FIG. 8 is a perspective view of an alternative form of prop according to the invention.

The prop shown in FIG. 8 is formed by a central pole 20 which is continuous throughout the length of the prop. The pole 20 is surrounded by a number of staves 21 which are each shorter than the pole 20 so that the pole 20 protrudes at either end of the prop. The staves 21 are held in place around the pole 20 by bands 22. The bands **22*a* nearest the ends of the staves act in the same manner as the restraining ring 13** of the previous embodiments.

Figure 9:
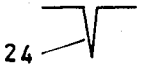
FIG. 9 is a cross-section through a reinforcing bar.

As an added reinforcement, metal bars 23 can be positioned between the staves so that the bars extend parallel to the axis of the prop. The metal bars may be made with a T-shape profile as shown in FIG. 9 with the stem 24 of the T-shape received between the staves.

In another embodiment (not shown), a prop as shown in any one of FIGS. 1 to 7 has saw cuts extending along the major portion parallel to the prop axis and through only that part of the major portion which lies outside the dotted line 14 and an extension of this line along the length of the prop. The bars 23 or 24 are then received in the saw cuts.

Figure 10:
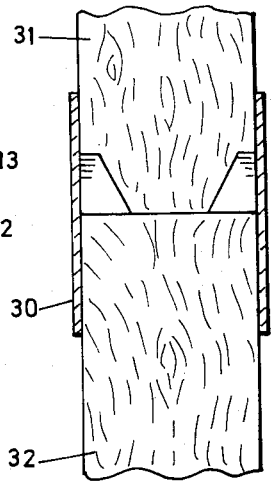
FIG. 10 shows how two props can be combined to form a longer prop.

FIG. 10 shows how two props can be joined together. Generally, props are made in standard lengths and it is impractical to make them in much longer lengths, because of difficulties in transporting them. To produce a longer prop, two props can be combined at or near the site where the prop is to be used. In particular, a prop according to the invention can be combined with another prop according to the invention or alternatively with a plain unshaped pole. FIG. 10 shows a prop 31 according to the invention with a profiled lower end combined with another prop 32 which may have a profiled or a plain lower end. It may also be appropriate in certain cases for the lower prop to have a profiled upper end such that, in the combined prop the two constituent props have their profiled ends in contact with one another.

To maintain the two props in line with one another, a metal sleeve 30 surrounds the joint between props 31 and 32. The upper prop 31 requires a restraint around its larger diameter portion in order to restrain hoop stresses, and this restraint is provided by the portion of the sleeve 30 which surrounds the prop 31. This portion of the sleeve 30 therefore acts in the same way as the rings 13 and 22*a* of earlier embodiments. This method of joining two props end to end can be used with any of the previously described embodiments, and results in the band 13 or 22*a* being omitted and being replaced by the end of the sleeve 30 which is located in the position which would have been taken up by the band 13, if present.

Figure 11:
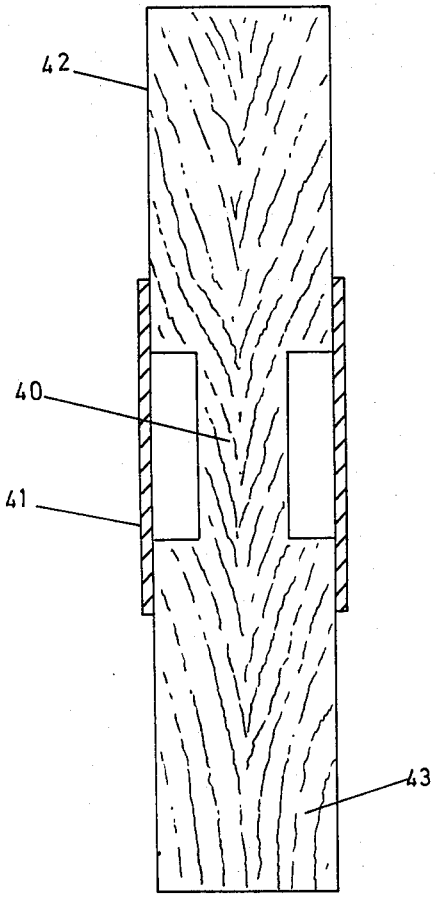
FIG. 11 is a cross-section through another embodiment of a prop according to the invention.

FIG. 11 shows a prop where the part 40 which is reduced in cross-section relative to the rest of the prop is located in the middle of the prop and is surrounded by a sleeve 41. The sleeve 41 has a similar function to the sleeve 30 of FIG. 10, in that it acts as a restraining ring around the parts of unreduced cross-section 42, 43 adjacent to the part 40, and also helps to prevent bowing or buckling of the prop about the part 40.

I claim:

1. A mine prop for use between a foot wall and a hanging wall in a mine working for supporting the hanging wall above the foot wall and for yielding to a shorter length under the load imposed axially on it by the hanging wall as the hanging wall descends towards the foot wall with the passage of time, while still offering resistance to the imposed load, said mine prop comprising:

(a) columnar timber pole means of substantially uniform cross-section and extending over a major portion of the length of the prop for resisting loads without significant compression thereof;

(b) integral timber protruding end portion means axially adjacent one end of the columnar pole means for compressive yielding under the imposed loads from an initial length to a lesser length, the protruding end portion mean extending over a minor portion of the length of the prop and tapering from its end adjacent the columnar pole means to its remote end;

(c) the cross-section of the protruding end portion means adjacent the columnar means being less than that of the columnar pole means so that there is a clearly defined shoulder between the protruding end portion means and the columnar pole means;

(d) a restraining ring around the columnar pole means around and engaging the columnar pole means adjacent the protruding end portion means for resisting hoop stresses arising in the columnar pole means as a result of the imposed loads;

whereby upon the application of the hanging wall imposed loads on the prop, the protruding end portion means yields compressively with a corresponding decrease in length, the tapered shape of the protruding end portion means ensuring that the imposed load is taken by progressively larger and larger cross-sections of the protruding end portion means during yielding, and whereby, after compressive yielding of the protruding end portion means has taken place, the imposed load is taken by the columnar pole means until collapse of the prop takes place.

2. The mine prop of claim 1, in which the columnar pole means has a circular cross-section and the protruding end portion means comprises an integral timber frusto-cone, the major diameter of which is less than the diameter of the columnar pole means.

3. The mine prop of claim 2, in which the clearly defined should lies in a plane normal to the axis of the columnar pole means.

4. The mine prop of claim 1, in which the restraining ring is a metal band.

5. The mine prop of claim 4, in which the metal band is positioned between 0 and 75 mm from the end of the columnar pole means adjacent the protruding end portion means.

* * * * *